US007886402B2

(12) United States Patent
Kihlström

(10) Patent No.: US 7,886,402 B2
(45) Date of Patent: Feb. 15, 2011

(54) WASTE MANAGEMENT

(75) Inventor: Christer Kihlström, Stockholm (SE)

(73) Assignee: Envac AB, Stockholm (SE)

( * ) Notice: Subject to any disclaimer, the term of this patent is extended or adjusted under 35 U.S.C. 154(b) by 180 days.

(21) Appl. No.: 12/304,058

(22) PCT Filed: Jun. 1, 2007

(86) PCT No.: PCT/SE2007/000535

§ 371 (c)(1),
(2), (4) Date: Feb. 17, 2009

(87) PCT Pub. No.: WO2007/142574

PCT Pub. Date: Dec. 13, 2007

(65) Prior Publication Data

US 2010/0218336 A1 Sep. 2, 2010

(30) Foreign Application Priority Data

Jun. 9, 2006 (KR) ..... 10-2006-0052031

(51) Int. Cl.
*A47L 5/38* (2006.01)

(52) U.S. Cl. ..... 15/301; 15/319

(58) Field of Classification Search ..... 15/301, 15/336, 314, 319, 317, 318, 318.1; 406/120, 406/130, 127, 168
See application file for complete search history.

(56) References Cited

U.S. PATENT DOCUMENTS 3,490,813 A 1/1970 Hallstrom
3,977,729 A 8/1976 Olson
4,013,551 A 3/1977 Feudis
4,037,795 A 7/1977 Fyfe
4,108,498 A * 8/1978 Bentsen ..... 406/117
4,185,973 A * 1/1980 Tester ..... 241/33
4,423,987 A * 1/1984 Powers ..... 406/56
4,995,765 A * 2/1991 Tokuhiro et al. ..... 406/117

FOREIGN PATENT DOCUMENTS

| | | |
|---|---|---|
| FR | 2300727 | 9/1976 |
| GB | 332968 | 8/1930 |
| GB | 1084689 | 9/1967 |
| WO | WO 02102686 A1 * | 12/2002 |

OTHER PUBLICATIONS

International Search Report dated Oct. 2007, in PCT application.

* cited by examiner

*Primary Examiner*—Dung Van Nguyen
(74) *Attorney, Agent, or Firm*—Young & Thompson

(57) ABSTRACT

Waste material that is introduced into waste inlet units (10) is managed by connecting the inlet units to a temporary storage volume (3) for charging the storage volume with the waste and by controlled, intermittent opening of the storage volume for the removal of accumulated waste therefrom. Specifically, waste is introduced into each inlet unit during an inlet charging phase; shaft charging vacuum (CV) is applied to the storage volume and is maintained continuously therein except when waste is removed from the storage volume; and the charging vacuum and atmospheric air (AA) is intermittently communicated to the inlet unit to charge the storage volume with the introduced waste.

20 Claims, 11 Drawing Sheets

ICP

ICP

ICP

ICP

SCP

SCP

SCP

SCP

WASTE MANAGEMENT

TECHNICAL FIELD

The present invention relates generally to waste management, and specifically relates to the management of domestic waste material by means of vacuum.

BACKGROUND

The handling of domestic waste using traditional vacuum systems has for many years been increasingly centralized both with regard to the introduction of waste into the vacuum system and to the collection and disposal of the waste. In other words, waste is collected further and further away from the place where it is generated and the system vacuum is used both for discharging temporarily stored waste and for transporting said waste to collection centrals or collection points.

For certain types of waste, such as kitchen waste containing a high-liquid fraction of mostly biological waste, it is desirable to dispose of the waste very close to the place were it is generated. In such situations it has been common, not least in households but also for processing waste from restaurants and commercial or institutional kitchens, to use garbage disposers or shredders for disintegrating the wet waste fraction containing food leftovers. Such equipment has normally been positioned directly under a sink and traditionally the shredded waste has been discharged directly into the sewerage, resulting in a heavy load on sewage systems and wastewater treatment plants. It has therefore been suggested to conduct the shredded waste to a storage container in the immediate vicinity of the infeed point, where the waste has been stored and/or further processed and from which the waste has then been discharged periodically.

RELATED ART

Among the systems used for managing disintegrated waste from a waste disposer or shredder, it is also known to use vacuum that is intermittently applied to the system, to suck the generated, introduced and processed waste to a collection point. The described systems are all associated with a grinder or disposer for disintegrating or milling the waste, and include systems using further equipment for reducing environmental problems appearing by this type of waste management, by preventing the discharge of shredded or milled waste directly into the sewerage. By virtue thereof the systems are not very cost efficient unless they are used in applications where they are in very frequent operation. They are sensitive to technical disturbance, thereby requiring regular service.

SUMMARY

The basic object of the invention is to provide effective and reliable, vacuum operated management of domestic waste.

In particular, it is an object of the invention to suggest an improved method of managing waste collected in a decentralized mode, close to the place where it is generated, providing cost effective and user friendly operation.

It is another object of the invention to provide an improved vacuum operated system for managing waste collected in a decentralized mode, said system being reasonable in cost and providing secure and convenient user operation.

These and other objects are met by the invention as defined by the accompanying patent claims.

The invention generally relates to managing waste by means of a vacuum operated system, wherein waste is introduced into the system in an inlet unit close to where it was generated. It has been recognized that improved, secure and reliable operation of such a system may be achieved by maintaining vacuum in the system during the entire operational phase thereof and by only connecting the vacuum pressure to the inlet during an inlet emptying phase. A basic idea is to employ a vacuum tank that is subjected to the continuous vacuum and to use it simultaneously as a temporary storage volume for collected waste, and to apply the tank vacuum to a closeable waste compartment of the inlet only during the inlet emptying phase.

By blocking charging access to the interior of the inlet unit during the inlet emptying phase, security against injuries is enhanced and noise and other inconvenience is reduced, and by automatically permitting access thereto again when the vacuum has been disconnected from the inlet unit, user convenience is enhanced.

Preferably, the operational vacuum pressure level is continuously sensed close to each inlet unit and application of the vacuum to the respective inlet is controlled based on the sensed vacuum level. This solution secures that an appropriate vacuum level for secure discharge of waste from the respective inlet is present before starting the inlet emptying phase. This is especially favourable for applications having multiple inlet units connected to one and the same vacuum tank.

In embodiments providing specifically good conditions for cost effective and secure emptying, the application of vacuum and atmospheric air to each inlet unit is performed during a limited time, the application of said vacuum and atmospheric air to each inlet unit is automatically interrupted after a selected time and fluid-tight blocking of the vacuum and atmospheric air application to the inlet is thereby likewise automatically effected.

In accordance with another aspect of the invention, improved management of waste at the place were it is generated may be applied to single-family or two-family detached or semi-detached houses. A basic idea of this aspect of the invention is to provide one or a few inlet units connected through waste pipes to a temporary storage volume having an openable bottom through which the collected waste is emptied into a waste container by gravity.

In accordance with a further aspect of the invention improved management of waste at the place were it is generated may be applied to multi-story buildings. A basic idea of this aspect is to provide inlet units in each apartment of a building and to connect the inlet units through separate pipes or a pipe network to a vertical shaft extending through the building and forming a temporary storage volume that is integrated in a conventional vacuum operated system by having a discharge valve opening into an underground waste transport pipe of the waste collection system.

According to yet another aspect of the invention, an improved inlet unit is provided for use in a vacuum operated waste management system. A basic idea of this aspect of the invention is to provide an inner inlet container being supported for rotation in an outer housing and having waste outlet and air inlet openings provided at a distance from each other around its periphery and air flow valve means for controlled opening and closing of said openings. With this design, effective, secure and user friendly operation may be obtained.

Waste management in accordance with the present invention offers further advantages, including:

- Requires only low vacuum pressure for secure discharge operation;
- Permits the use of low-cost materials and standardized equipment; thereby Allowing for low-cost manufacturing;

Low sensitivity to mechanical disturbance by being mechanically robust;

Flexible with regard to the number of connected inlet units;

Easily adaptable to different types of buildings and to alternative emptying techniques; and Easily adaptable to different applications for different types of waste.

Advantages offered by the present invention, in addition to those described above, will be readily appreciated upon reading the below detailed description of embodiments of the invention.

Preferred, further developments of the basic inventive idea as well as embodiments thereof are specified in the dependent subclaims.

BRIEF DESCRIPTION OF THE DRAWINGS

The invention, together with further objects and advantages thereof, will be best understood by reference to the following description taken together with the accompanying drawings, in which.

DETAILED DESCRIPTION

The invention will now be explained with reference to embodiments that are illustrated in the accompanying drawing figures and that exemplify the use of the inventive waste management principles in applications that include waste inlet units positioned in residential houses and buildings, close to a place were waste is generated. It shall be emphasized, though that the illustrations are for the purpose of describing preferred embodiments of the invention and are not intended to limit the invention to the details thereof.

Figure 1:
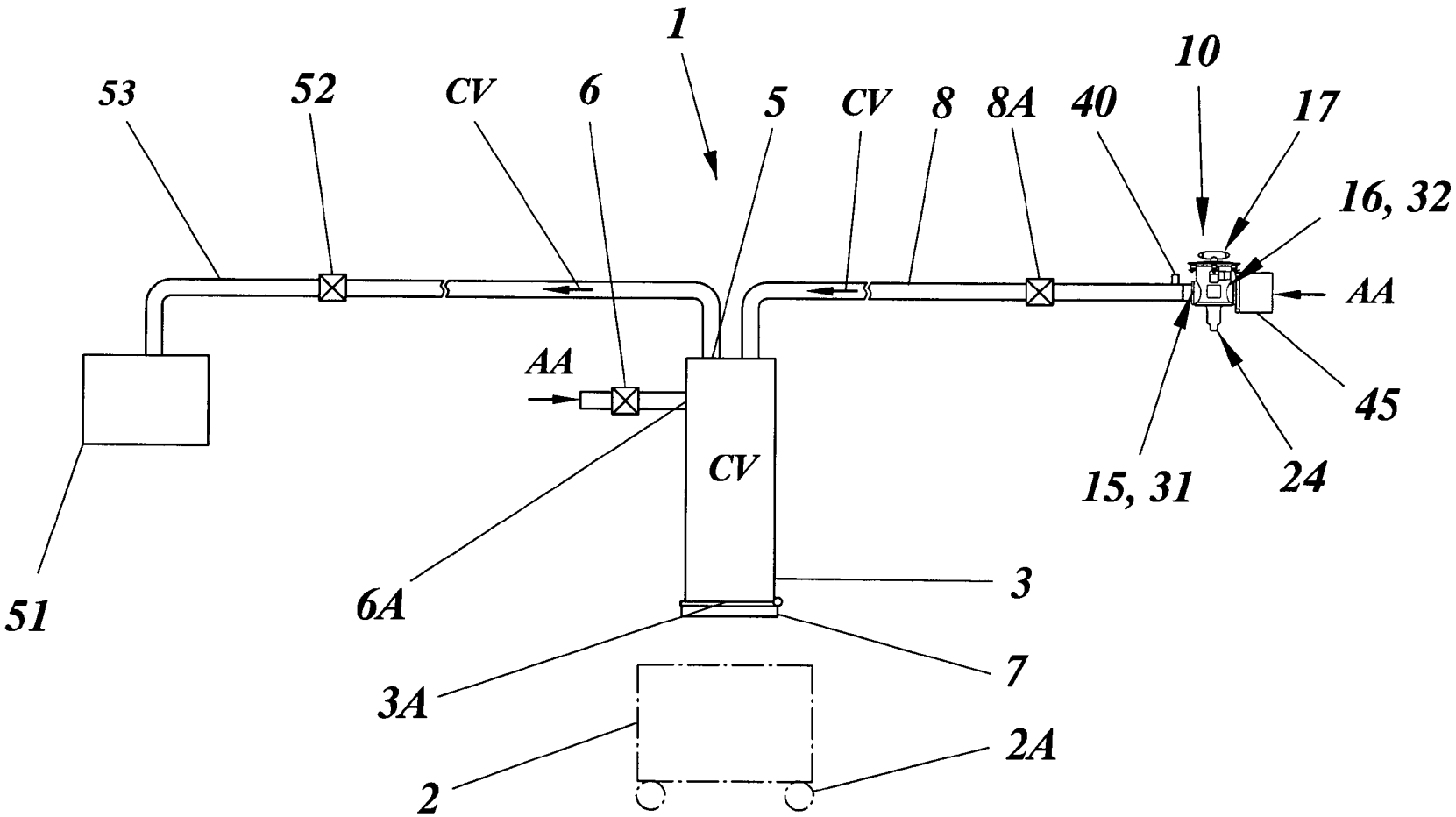
FIG. 1 is a partly schematical illustration of a first embodiment of a waste management system according to the invention.
Figure 8:
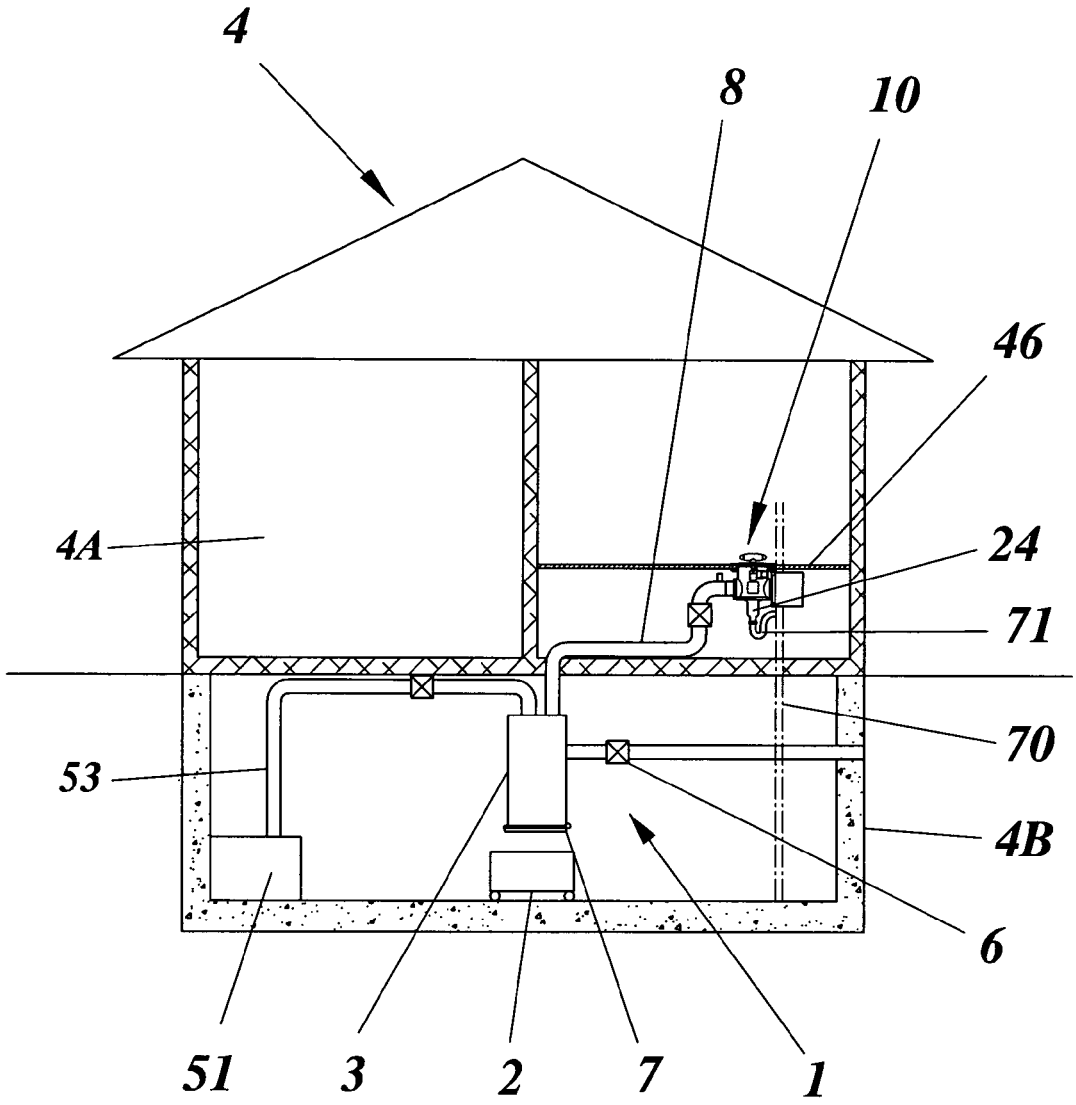
FIG. 8 illustrates a practical application of the first embodiment of the invention in a detached house.

A first exemplifying embodiment of the invention is shown in FIG. 1 and an exemplary application thereof is shown in FIG. 8. This first embodiment relates to a domestic waste management system 1 that comprises a separate temporary storage volume 3 for the collected waste. The storage volume has a bottom opening 3A that is closed by an openable lid 7 and through which collected waste may be removed intermittently and in a controlled manner from the storage volume 3 by gravity. Said waste may be discharged into a suitable container 2 preferably having wheels 2A to facilitate further transfer of the collected waste. The storage volume 3 is connected through a vacuum inlet 5, a vacuum pipe 53 and a charging vacuum valve 52 to a vacuum pressure source 51 delivering a moderate vacuum pressure CV that depends upon the actual application, such as the number of the later described inlet units 10 connected to the storage volume 3 and the length of the likewise later described waste pipes 8 in the system. In a practical application the pressure may preferably lie above approximately 25 kPa, preferably in the area of 30-40 kPa. It shall be emphasized though, that this range is given only to exemplify the pressure and that the invention is not restricted thereby.

Figure 2:
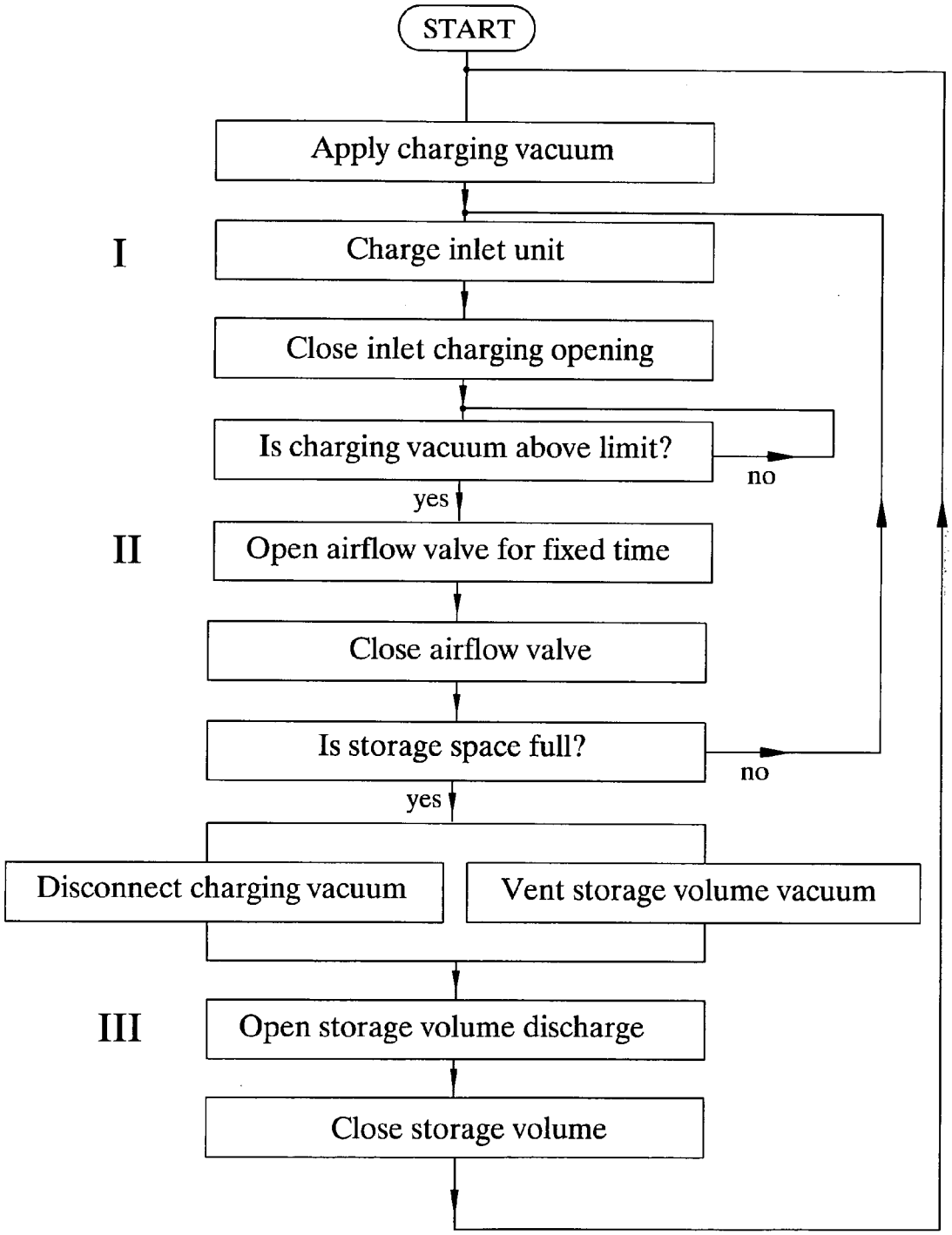
FIG. 2 is a schematical illustration of a first embodiment of a waste management method employing the system according to FIG. 1.

The vacuum valve 52 is normally open and is only closed to disconnect the vacuum from the storage volume 3 in connection with emptying the collected waste therefrom in a storage volume emptying phase III (FIG. 2). In practice, the storage volume 3 thereby functions as a vacuum tank continuously providing charging vacuum CV for the later described operation of the system 1. The storage volume 3 is also connected to the atmosphere through an air inlet opening 6A and an atmospheric air valve 6 that is normally closed and is opened only shortly prior to and during the actual storage volume emptying phase III. It functions as a vacuum release valve 6 by selectively introducing atmospheric air AA into the temporary storage volume 3 to ventilate the storage volume after closing the vacuum valve 52 and before opening the bottom lid 7.

Figure 3:
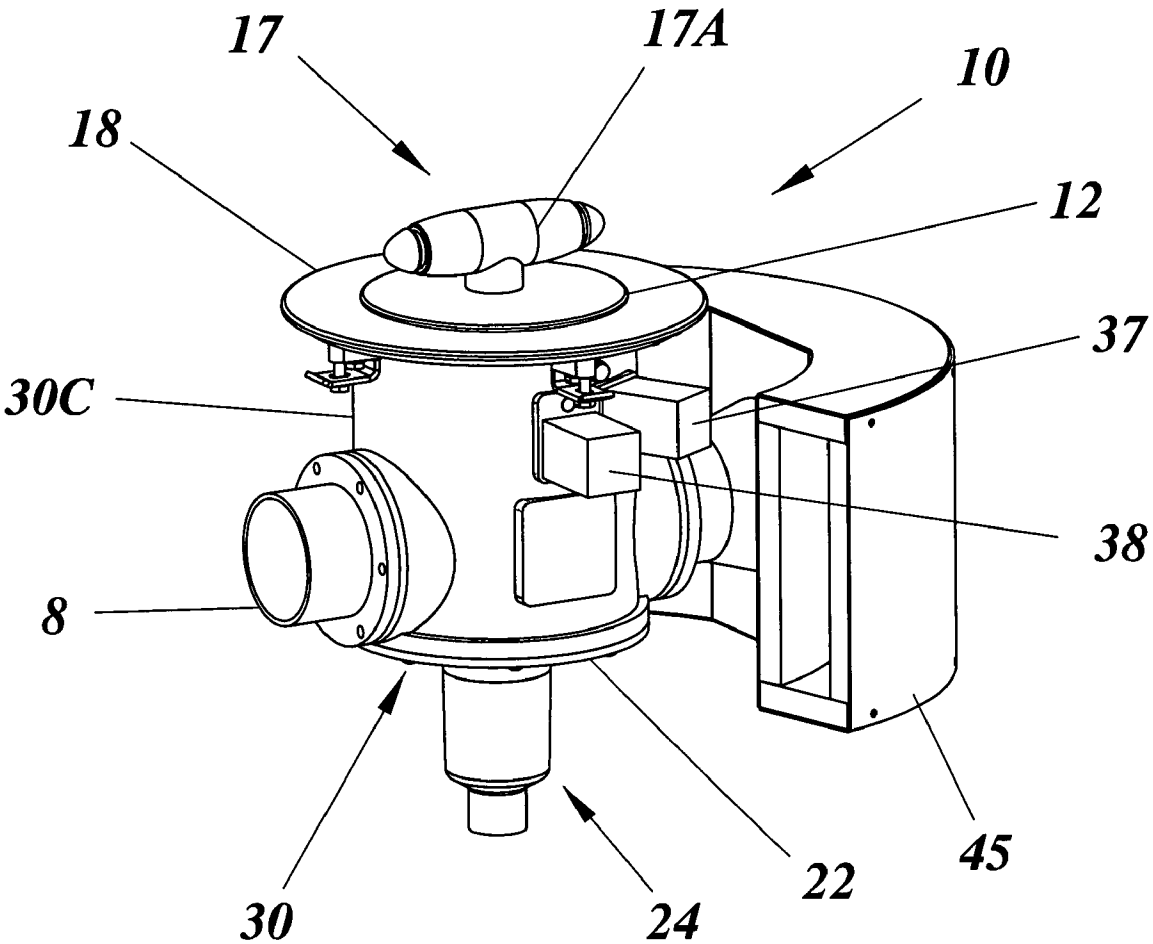
FIG. 3 is a perspective view of an inlet unit of the waste management system of FIG. 1.
Figure 5D:
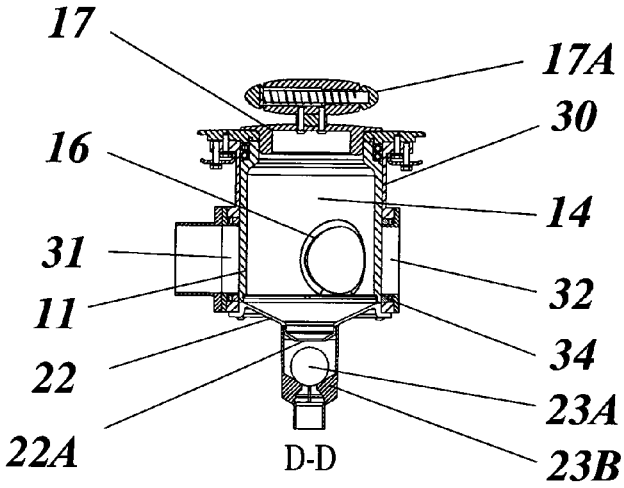
FIG. 5A-D illustrate the inlet unit of FIGS. 3 and 4 in an inlet charging position and in a side view, a sectioned top view, a top view and a sectioned side view, respectively.
Figure 5C:
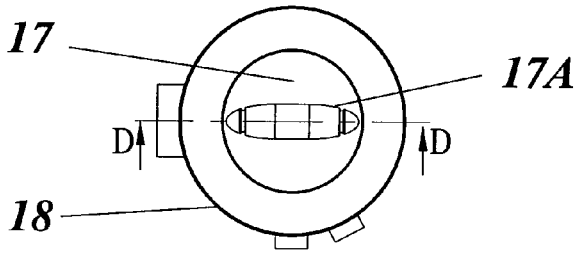
Figure 5B:
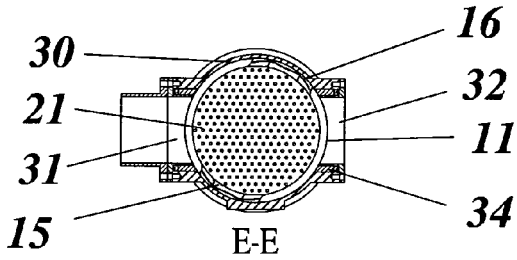
Figure 5A:
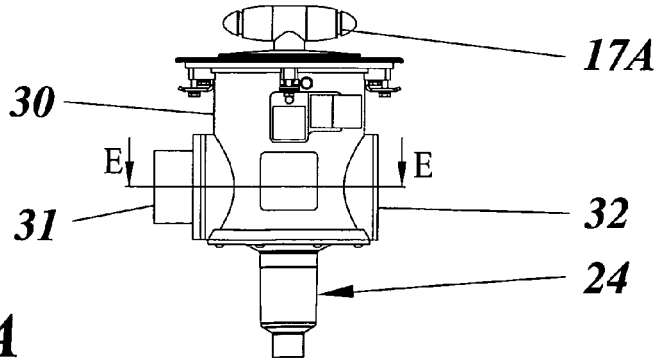
Figure 6D:
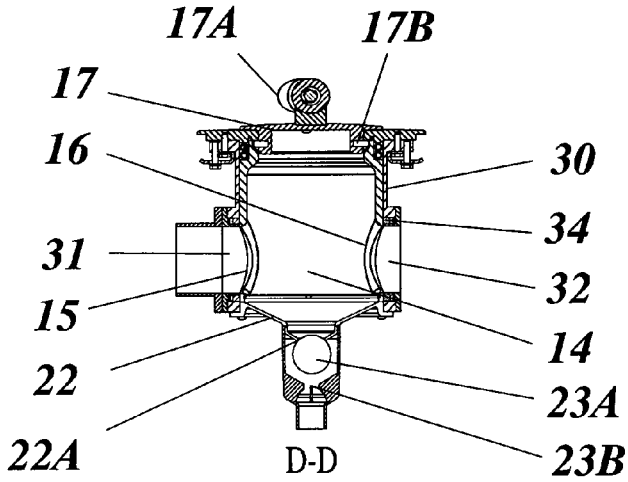
FIG. 6A-D illustrate the inlet unit of FIGS. 3 and 4 in an temporary storage volume charging position and in views corresponding to those of FIGS. 5A-D.
Figure 6C:
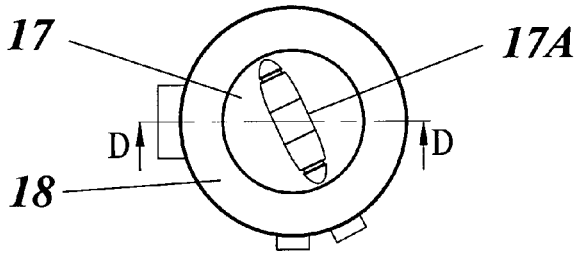
Figure 6B:
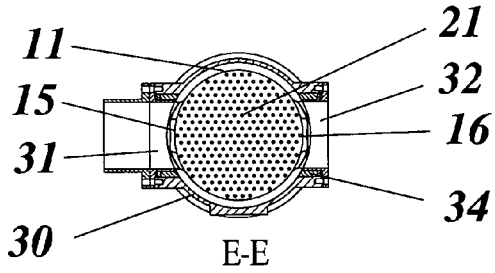
Figure 6A:
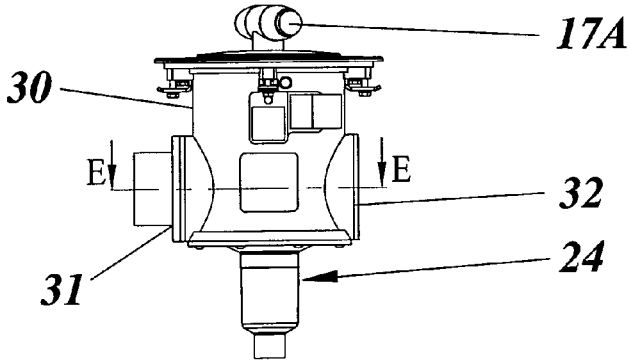

The system further comprises at least one inlet unit 10 positioned at or in the vicinity of a place where waste is generated, such as in the kitchen bench-top 46 schematically illustrated in FIG. 8. The inlet unit 10 is connected to the temporary storage volume 3 through a waste pipe 8 that has a service valve 8A allowing for a temporary isolation of the inlet unit 10 from the charging vacuum CV for service purposes. In the pipe 8 is provided a vacuum level sensor 40 of any conventional kind, through which the instant vacuum pressure in the waste pipe 8 is monitored closely downstream from the inlet unit 10. The inlet unit 10 has a waste inlet opening 12 that is hermetically closeable by means of a cover 17 and through which waste may be introduced into an interior waste compartment 14, as is illustrated in detail in FIGS. 4, 5D and 6D and is specifically described further below. Waste outlet openings 15, 31 (FIGS. 4, 5D and 6D) communicating the waste compartment 14 with the waste pipe 8 and atmospheric air inlet openings 16, 32 (FIGS. 4, 5D and 6D) communicating the waste compartment 14 with atmospheric air AA through a silencer 45, are provided in the inlet unit 10. Air flow valve means 15, 16, 31, 32, 34 (FIG. 4) are provided for controlling opening and closing of the waste outlet openings 15, 31 and atmospheric air inlet openings 16, 32. The output from the vacuum level sensor 40 is transferred to a control means 37 (FIG. 3) that controls operation of the air flow valve and thereby the application of charging vacuum CV and atmospheric air AA to the waste compartment 14 by blocking such application when the monitored vacuum pressure is below a set minimum value required to securely discharge the introduced waste into the storage volume 3.

In the exemplary embodiment that is specifically intended for managing wet domestic waste, such as food or kitchen waste, the inlet unit 10 is at the bottom thereof provided with a liquid drain 24. The liquid drain 24 is used to drain water and other liquid from waste introduced into the inlet unit 10 and may advantageously be connected through a water trap to the sewage system of a house 4 (FIG. 8) where the system 1 is installed.

Figure 4:
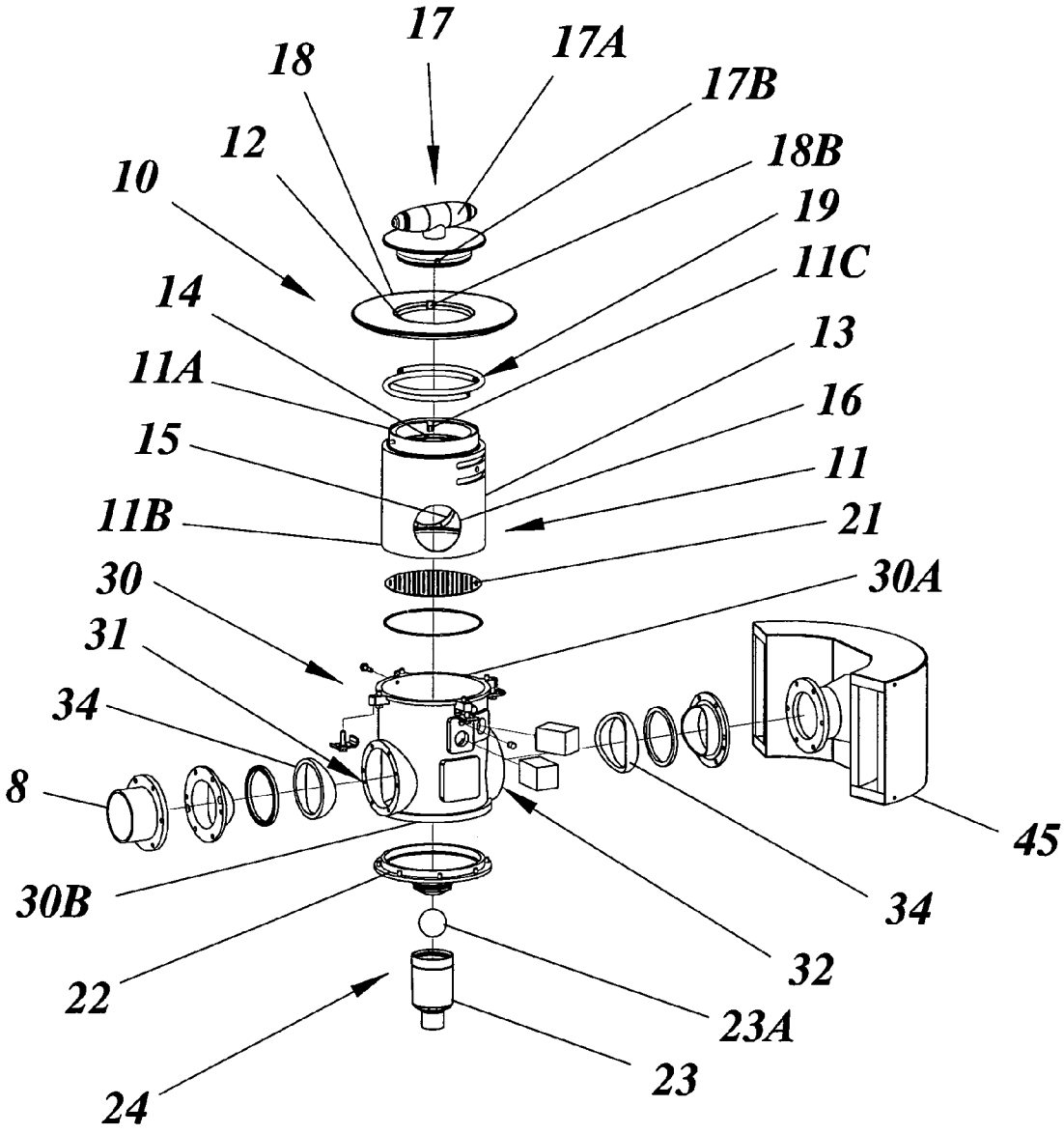
FIG. 4 is an exploded view of the inlet unit of FIG. 3.

A basic embodiment of an exemplary waste management method of the invention will now be described with reference to FIG. 2 and to the schematical system 1 of FIG. 1. With the system 1 ready for operation, the charging vacuum valve 52 is opened to apply vacuum CV to the vacuum tank/storage volume 3 through the vacuum inlet 5. The vacuum CV is then maintained in the vacuum tank 3 volume except for a limited period during a temporary storage volume emptying phase III when waste material is removed from the temporary storage volume/vacuum tank 3, as will be described later. In this initial or normal condition the air valve 6 and the bottom lid 7 are closed, the service valve 8A is open and the air flow valve 15, 16, 31, 32, 34 is closed so that charging vacuum CV is continuously maintained in the vacuum tank 3 and in the waste pipe 8 immediately downstream of the inlet unit 10. In this situation, during an inlet charging phase I, the cover 17 may, at any time be opened so that the closeable inlet unit waste compartment 14 may be charged by receiving waste material introduced therein through the inlet opening 12. When the waste compartment 14 has been charged, the cover 17 is fitted again and is locked in a closed position, such as by a later described bayonet type lock 17B, 18B (FIG. 4).

To discharge the collected waste from the waste compartment 14 the air flow valve 15, 16, 31, 32, 34 is opened, provided that the vacuum level that is continuously monitored by the vacuum level sensor 40, exceeds the preset limit value. If the vacuum level is below the set lower limit, opening of the air flow valve and thereby communication of charging vacuum CV to the waste compartment 14 is blocked until the vacuum pressure is above the limit again. When operation of the air flow valve is allowed, it is opened for a predetermined time during a temporary storage volume charging phase II, to communicate charging vacuum CV and atmospheric air AA intermittently to the waste compartment 14, through the waste outlet openings 15, 31 and atmospheric air inlet openings 16, 32. The introduced waste is sucked from the waste compartment 14 to charge the temporary storage volume 3. The air flow valve 15, 16, 31, 32, 34 is then automatically closed, to interrupt communication of charging vacuum CV and atmospheric air AA to the waste compartment 14 after a selected time, in the area of 5-20 seconds, preferably approximately 10-15 seconds, terminating the temporary storage volume charging phase II.

Specifically, it should now be clear that in the described operational phases, fluid-tight blocking of the charging vacuum CV and atmospheric air AA communication to the waste compartment 14 is secured during the inlet charging phase I and charging vacuum CV and atmospheric air AA is selectively communicated to the inlet unit 10 waste compartment 14 during the temporary storage volume charging phase II being of a specified, limited duration. Furthermore, liquid is continuously drained from the inlet unit waste compartment 14, through the liquid drain 24, at least during the inlet charging phase I. In particular, liquid is preferably drained therefrom at all times, except during the temporary storage volume charging phase II. During said phase II the liquid drain 24 is automatically closed by the applied charging vacuum CV, as will be clear from FIG. 4 and the accompanying description.

Waste introducing access to the waste compartment 14 is blocked during application of charging vacuum CV to the inlet unit 10 in the storage volume charging phase II and access thereto is then automatically permitted again in the following inlet charging phase I when the communication of charging vacuum CV to the waste compartment 14 has been interrupted.

After completion of the temporary storage volume charging phase II by closing the air flow valve, the system 1 returns to the inlet charging phase I, ready for the introduction of new waste into the waste compartment 14. However, in case the temporary storage space 3 is filled with collected waste up to an upper limit, which may be sensed by a separate level sensor (not illustrated), or earlier, the storage space will be emptied in a temporary storage volume emptying phase III. In this phase, the application of charging vacuum CV to the temporary storage volume 3 is first interrupted by closing the valve 52, and atmospheric air AA is then selectively introduced into the temporary storage volume 3 by opening valve 6, to vent the charging vacuum therefrom, prior to the removal of waste material from the storage volume. After completing the emptying phase III of the temporary storage volume 3, the connection of atmospheric air AA to the temporary storage volume is terminated and charging vacuum CV is re-applied thereto so that the system 1 is ready for new inlet charging phases I and temporary storage volume charging phases II.

A presently preferred embodiment of the inlet unit 10 will now be described in detail, with specific reference to FIGS. 3-4, 5A-D and 6A-D. The inlet unit 10 consists of an outer housing 30 having a fixed upper ring 18 attached to a first end 30A thereof and in turn defining a central waste inlet opening 12 that may be closed and sealed by means of a removable cover 17 provided with a handle 17A by means of which the cover 17 may be turned and lifted. The cover 17 is locked in closed position by means of a bayonet type lock formed of pins 17B extending outwardly from the cover 17 and being insertable through grooves 18B in the inner surface of the ring 18, so that they engage the ring 18 from below when the handle and the cover is turned, as will be described further below. At a second end 30B thereof, the outer housing 30 is provided with a likewise fixed bottom wall 22 that is closed except for a central drain opening 22A (FIGS. 5D, 6D) being part of the liquid drain 24. One end of a drain cup 23 is fitted to the outer housing 30, surrounding the drain opening 22A, and a second end of this drain cup may be connected to a water trap 71 (FIG. 8) and then to a sewage system. A ball 23A is received in the drain cup 23 and serves to automatically close the drain opening 22A when charging vacuum CV is applied to the inlet unit 10 during the storage volume charging phase II. When unaffected by the vacuum the ball 23A is supported on thin support wings 23B in the cup 23, allowing liquid to pass thereby.

In the circumferential wall 30C of the outer housing 30 is formed a waste outlet opening 31, to which a waste pipe 8 is connected for selectively applying the charging vacuum CV to the inlet unit 10, and an atmospheric air inlet opening 32, which is connected, through a silencer 45, to the atmosphere for selectively introducing atmospheric air AA there through. The waste outlet and atmospheric air inlet openings 31 and 32, respectively, are formed at a circumferential distance from each other in the outer wall 30C, and are preferably arranged directly opposite each other. Resilient seals or gaskets 34 are fixed to the inner side of the outer housing, each surrounding the respective opening 31, 32 and having a shape suitable for sealingly engaging a later described inner container 11. Two electrical holding magnets 37, 38 are fixed to the circumferential wall 30C of the outer housing 30 and their respective holding pins (not specifically illustrated) are extendable into and retractable from associated bores (likewise not specifically illustrated) in an inner container 11 to control the later described rotation thereof.

The inner container 11 has a generally cylindrical shape with open first and second ends 11A, 11B, respectively. It forms an inner waste compartment 14 and is supported for rotation in the outer housing 30. By means of appropriate, not specifically illustrated seal means the inner container 11 is sealed against the outer housing 30 both at its upper end 11A and at its lower end 11B thereby preventing waste being introduced from entering there between and preventing said waste from escaping from the inner container 11 at the bottom 22. At said lower end 11B the inner container 11 has a sieve 21 holding back solid waste in the waste compartment 14, but allowing liquid to escape through the liquid drain 24 and to the sewage at all times except during the storage space charging phase II when the applied charging vacuum CV lifts the ball 23 so that it seals the central drain opening 22A to prevent back draught in the sewage. A waste outlet opening 15 and an atmospheric air inlet opening 16 are provided in a peripheral outer wall 13 of the inner container 11, at a circumferential distance from each other corresponding to that between the waste outlet opening 31 and atmospheric air inlet openings 32 in the outer wall 30C of the outer housing 30. Air flow valve means for selectively opening and closing communication between the charging vacuum CV and the atmospheric air AA, through the waste compartment 14, are formed by the waste outlet and atmospheric air inlet openings 15, 16, respectively of the inner container 11, the waste outlet and atmospheric air inlet openings 31 and 32, respectively, of the outer housing 30 and the resilient seals or gaskets 34. The opening and closing, respectively of the air flow valve means 15, 16, 31, 32, 34 is controlled by the rotation of the inner container 11 by approximately 60 to 90°. The inner container is rotatable between an inlet charging position ICP that is specifically illustrated in FIGS. 5A-D, and a storage volume charging position SCP that is specifically illustrated in FIGS. 6A-D. In the inlet charging position ICP as well as during most of the rotation of said inner housing, the respective waste outlet openings 15, 31 and atmospheric air inlet openings 16, 32 are hermetically sealed from each other by the seals 34 engaging an outer surface of the peripheral outer wall 13 of the inner container 11. In the storage volume charging position SCP the waste outlet openings 15, 31 and atmospheric air inlet openings 16, 32 of the inner container 11 and the outer housing 30, respectively, are aligned to allow air flow through the waste compartment 14.

In the illustrated embodiment, the inner container 11 is rotated manually between said positions. Specifically, with the cover 17 in position in the waste inlet opening 12, the bayonet lock pins 17B thereof engage cutouts 11C at the first, upper end 11A of the inner container 11, so that rotation of the handle 17A brings the inner container 11 to rotate between the normal inlet charging position ICP, wherein the air flow valve 15, 16, 31, 32, 34 is closed and the waste outlet openings 15, 31 and atmospheric air inlet openings 16, 32 are hermetically sealed from each other, and the storage volume charging position SCP wherein air flow is created through the waste compartment 14 to remove the introduced waste therefrom. With the rotation of the inner housing 11, a return spring 19, that is positioned around the inner container 11 and is fixed thereto and to the outer housing 30, is loaded. The inner container is held in the storage charging position SCP for a set time of preferably approximately 10-15 seconds by means of the electrical holding magnet 38 engaging a not specifically illustrated bore. A timer (not illustrated) controls the electrical holding magnet 38 to release said bore after the set time, whereupon the return spring 19 rotates the inner housing back to the inlet charging position ICP. During rotation to and from the storage charging position SCP and in said position the cover is locked in its closed and sealed position by the engagement of the bayonet lock pins 17B with the underside of the ring 18. When the inner container 11 has reached the inlet charging position ICP again, the cover 17 may be removed since the pins 17B are aligned with the grooves 18B in the inner surface of the ring 18. Thereby the inlet unit 10 is ready for a new inlet charging phase I. The other electrical holding magnet 37 is controlled by the vacuum sensor 40, so that its holding pin is extended to engage a (not specifically designated) bore in the inner container 11 and to block rotation thereof when the vacuum pressure in the waste pipe 8 falls below the set lower limit, and that its pin is retracted to free the inner container 11 when the set vacuum pressure level is reached. This function is especially important in applications where the system 1 has several waste inlet units 10 and where it must be secured that the correct vacuum pressure is present immediately downstream of each inlet unit 10 before opening the associated air flow valve.

Figure 7:
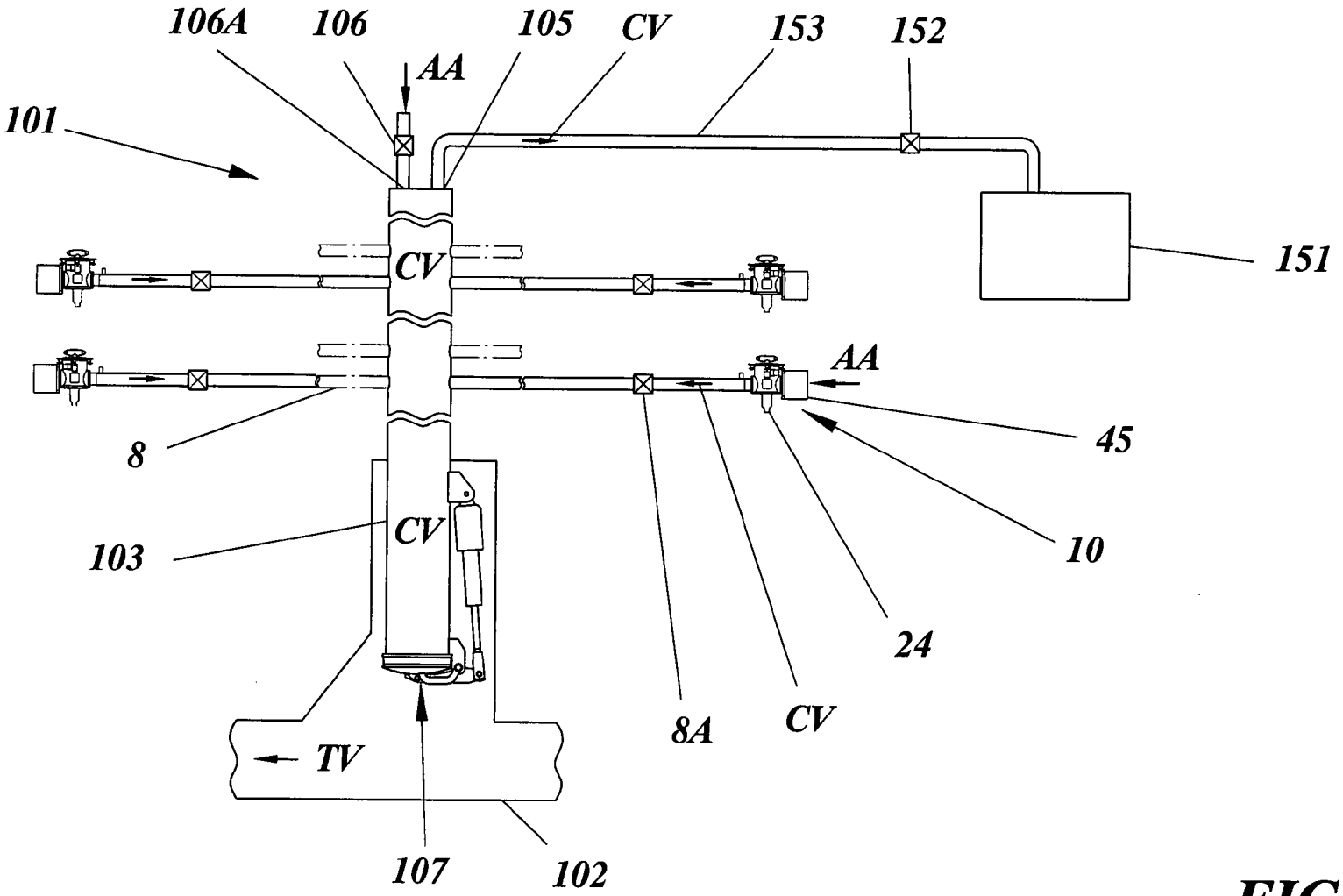
FIG. 7 is a partly schematical illustration of a second embodiment of a waste management system according to the invention.

FIG. 7 illustrates a second embodiment of the inventive waste management system. This system 101 is generally very similar to the one of the first embodiment, but has several inlet units 10. The illustrated inlet units 10 are all identical to those of the first embodiment and are all connected to a temporary storage volume 103 through waste pipes 8. However, in this embodiment the storage volume 103 is formed as a vertically extended waste shaft that at its lower end is integrated in a vacuum waste transport system consisting of a waste transport pipe 102 connected to the waste shaft 103 through a waste shaft discharge valve 107, for applying waste transport vacuum VT thereto from a collection central spaced from the inlet units. In other words, in the storage volume emptying phase III, the waste shaft discharge valve 107 opens the lower end of the waste shaft 103 into the transport pipe 102 so that waste collected in the waste shaft 103 may be removed therefrom by the transport vacuum VT. This discharge valve 107 is not described in detail, but may preferably be of the kind disclosed in WO 02/102686, to which reference is made in this respect.

At its upper end or in any other suitable position therein, the waste shaft 103 is likewise connected through a vacuum inlet 105, a vacuum pipe 153 and a charging vacuum valve 152 to a vacuum pressure source 151 delivering the charging vacuum pressure CV. The temporary storage volume or vacuum tank 103 is, like before, connected to the atmosphere AA through an air inlet opening 106A and an atmospheric air valve 106. The operation and function of this second embodiment and its different valves and pipes is the same as for the first embodiment, except for the fact that there are several inlet units connected and that the emptying of the collected waste from the temporary storage volume/vacuum tank 103 is not manual and by gravity but is integrated in the conventional vacuum waste transport system.

In FIG. 8 is illustrated an example of a practical application of the first embodiment of the inventive waste management system 1 (slightly exaggerated in size, for reasons of clarity) in a detached single-family house 4 having an apartment 4A for a single family and a basement 4B. Here, the vacuum source 51, the vacuum line 53 and the temporary storage volume 3 are installed in the basement 4B, with the storage volume provided at a suitable height above the basement floor for convenient emptying thereof into the transfer container 2. The inlet unit 10 is installed in a kitchen bench top 46 and accordingly the system 1 is here primarily intended for managing wet kitchen or food waste. Accordingly a liquid drain 24 from the inlet unit 10 is connected through a water trap 71 to the sewage system 70 of the house 4. In such an application the waste pipe 8 and the related equipment will be easily accommodated under the bench-top 46, from where the waste pipe 8 may be directly connected to the storage volume 3.

The house 4 is shown in FIG. 8 as a detached single-family house 4, but the illustrated system 1 may with minor or no modifications other than the addition of an inlet unit, be used in a two-family house, such as a semi-detached house. It should also be emphasized that for a house lacking a basement, the vacuum tank and the vacuum source may instead be provided in another suitable area of the house, such as a garage, or in a separate shed or other suitable small building.

In applications having one or a few inlet units, each inlet unit is preferably connected directly to the storage volume through a separate waste pipe and the storage volume is emptied by gravity, through the bottom thereof. However, this does not exclude alternative solutions where small pipe networks are formed also for small numbers of inlet units and/or where storage volumes of several small systems for the respective detached or semi-detached houses are connected, through a suitable valve, to a central vacuum transport pipe for vacuum emptying thereof.

Figure 9:
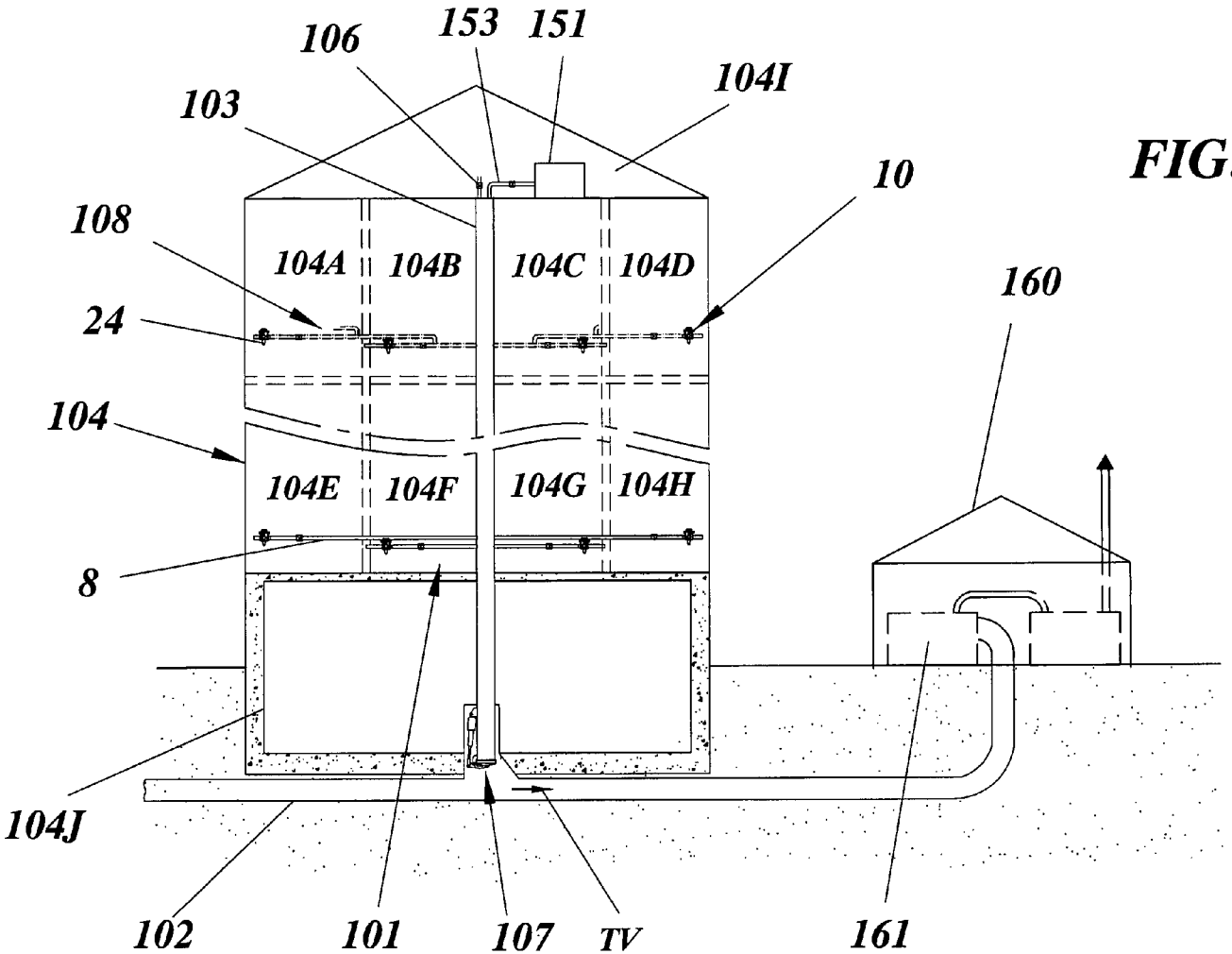
FIG. 9 illustrates a practical application of the second embodiment of the invention in a multi-story building.

In FIG. 9 is illustrated an example of a practical application of the second embodiment of the inventive waste management system 101 in a multi-story building 104 having multiple single-family apartments 104A-104H, an attic 104I and a basement 104J. Here, the waste shaft/temporary storage volume 103 is extended vertically through the building 104 and the vacuum source 151 and the vacuum line 153 are shown installed in the attic 104I of the building 104. The discharge valve 107 is provided at the lower end of the temporary storage volume 103, in the basement 104J. In this application of the waste management system 101 the storage volume is integrated in a vacuum waste transport system for emptying of the waste collected in the storage volume 103. Specifically, the discharge valve 107 opens into a transport pipe 102 and through the opened discharge valve 107 and said transport pipe 102 waste transport vacuum VT is applied to the waste shaft 103 from a collection central 160 being spaced from the inlet units 10 and having a vacuum pressure source 161. In this application the multitude of inlet units 10 are each arranged in a separate apartment 104A-H, likewise preferably supported in a kitchen bench top (not illustrated), and are connected either directly to the storage volume 103 through a separate waste pipe 8, and/or are alternatively connected thereto through a pipe network 108. In case the waste management system 101 is to be used mainly for wet kitchen waste, the liquid drain 24 from the inlet units 10 may, as illustrated in FIG. 8 for the application of the first embodiment, be connected to the sewage system (not specifically shown here) of the building 104. As a complement or an alternative thereto, the discharge valve 107 at the bottom of the storage volume/waste shaft 103 may be combined with a waste dewatering system of the kind disclosed in our Korean Patent Application No. 10-2005-07421.

Figure 10:
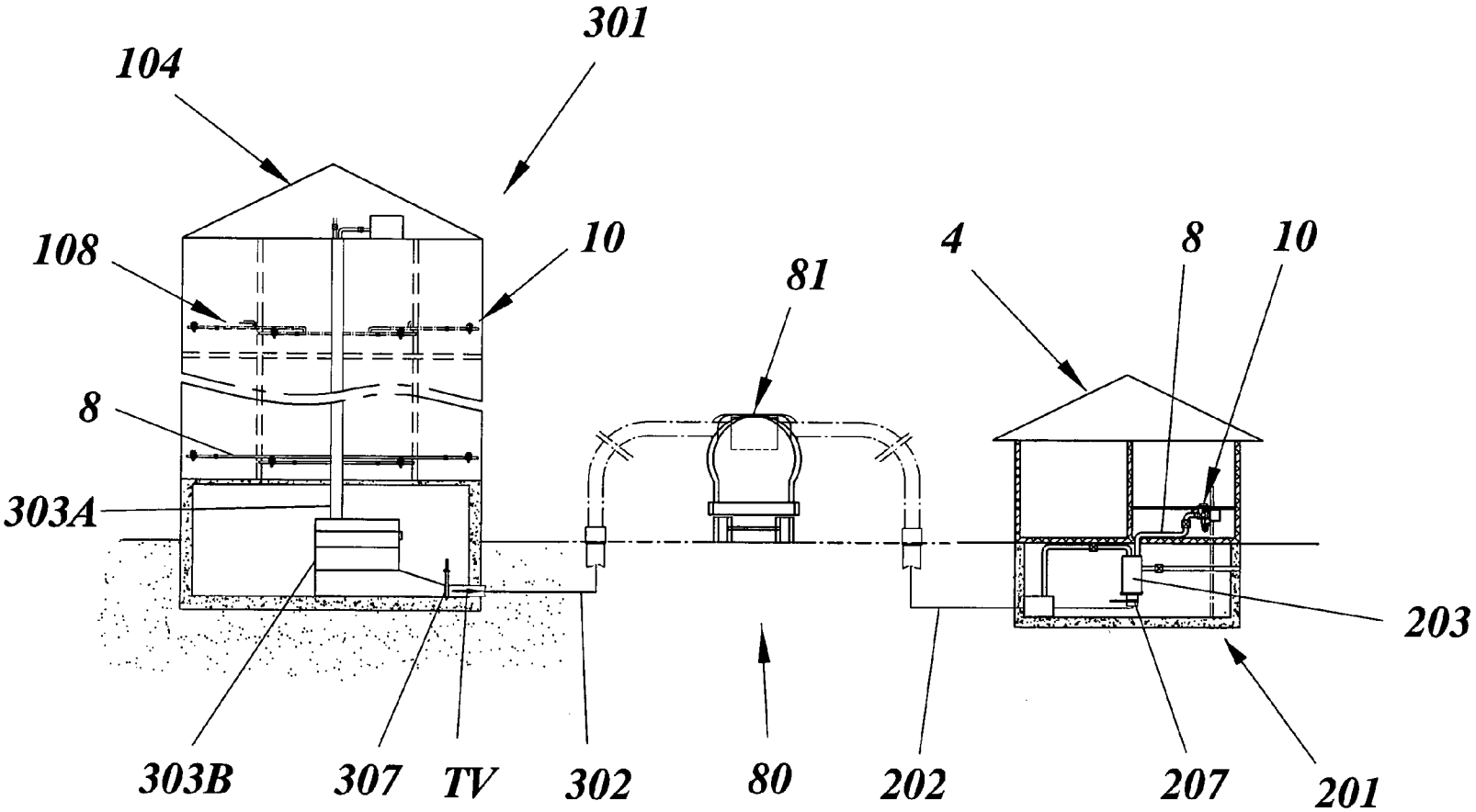
FIG. 10 illustrates further applications of the invention.

In FIG. 10 are illustrated further schematical applications of variations 201 and 301 of the first and second embodiments of the inventive waste management system. To the right in this drawing figure is illustrated a residential single or two-family detached or semi-detached house 4 like the one in FIG. 8 having a waste management system 201 likewise being similar to the first embodiment of the invention. However, in this case the temporary storage volume 203 is integrated in a mobile vacuum waste transport system 80 connected thereto for performing the emptying. The storage volume 203 has a waste discharge valve 207 that opens into a waste transport pipe 202 of the mobile vacuum waste transport system 80 and through which waste transport vacuum TV is applied to the storage volume 203 from a vacuum truck 81. This variant of the inventive waste management is also suitable for application to an area of residential single or two-family detached or semi-detached houses that may each have their own storage volume and that may be connected separately or simultaneously to the vacuum truck for emptying.

To the left in this drawing figure is illustrated a multi-story building 104 like the one in FIG. 9, having a waste management system 301 that is similar to the second embodiment of the invention. Here, the temporary storage volume consists of the waste shaft 303A and a separate waste tank 303B to which it is connected, and is illustrated integrated in the mobile vacuum waste transport system 80 connected thereto for performing the emptying. The waste tank 303B is likewise illustrated having a waste discharge valve 307 that opens into a waste transport pipe 302 of the mobile vacuum waste transport system 80 and through which waste transport vacuum TV is applied to the storage volume 303A, 303B from the vacuum truck 81.

Specifically, this drawing figure clarifies that the basic waste management of the invention is not restricted to any specific emptying method or system for discharging collected waste from the temporary storage volume. Instead, the inventive system may be used with most of the presently known techniques for emptying or discharging waste from a storage space.

Figure 11B:
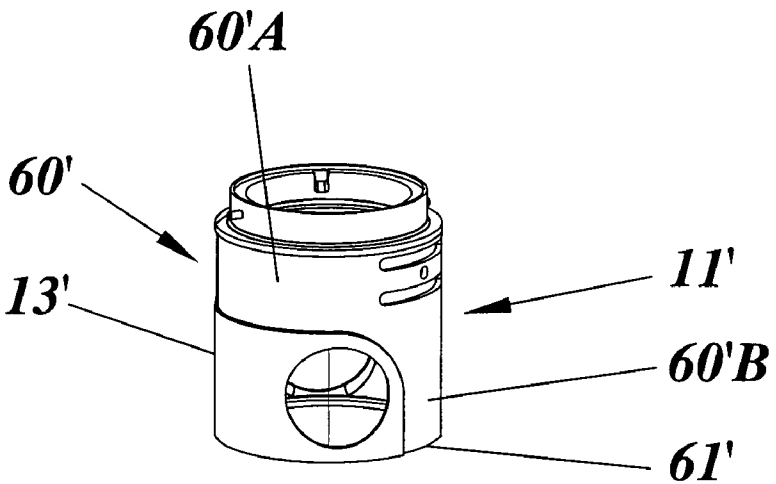
FIG. 11B illustrates an inner container of the modified embodiment of the inlet unit.
Figure 11A:
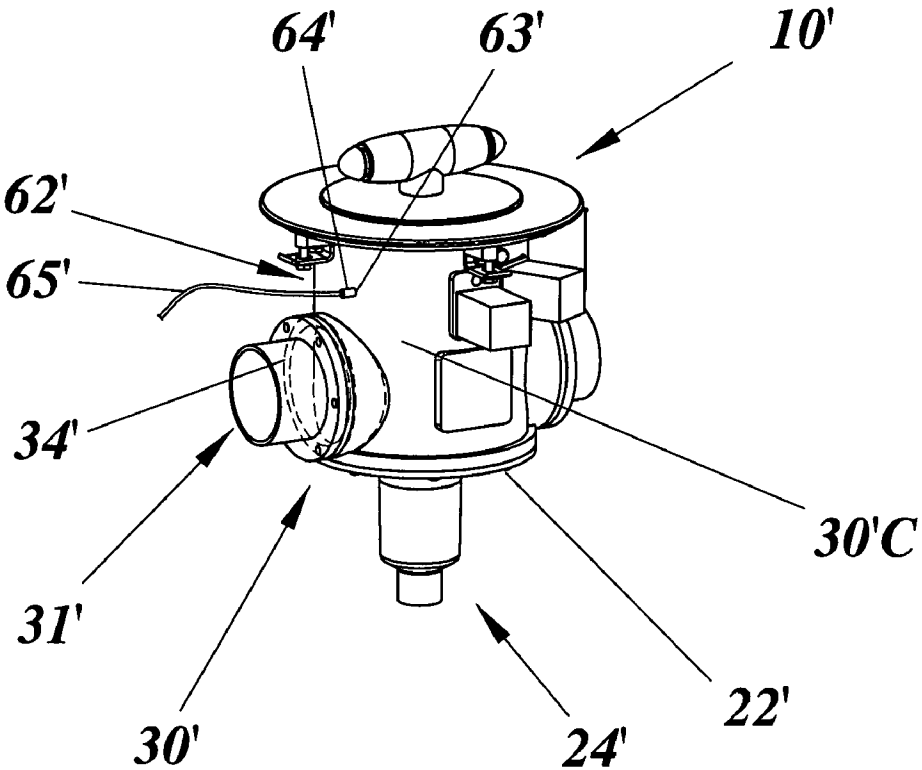
FIG. 11A illustrates a modified embodiment of an inlet unit having a flush water supply.

In FIGS. 11A-B is illustrated a modified embodiment of an inlet unit 10' according to the invention. In this embodiment measures have been taken to secure reliable operation of the inlet unit even in cases where waste would get past the seal members 34' (described and illustrated in detail in connection with FIGS. 4, 5A-D and 6A-D, but only vaguely indicated in FIG. 11A) sealing between the outer housing 30' of the inlet unit 10' and the inner container 11' during rotation of the latter. This may happen in special circumstances where food waste of specific consistency is frequently inserted into the inlet unit 10'. A proposed inventive solution to such possible problems is characterized by the provision of a recess 60' that is formed in and covers parts of the outer surface of the peripheral outer wall 13' of the inner container 11'. Specifically, the recess 60' covers only parts of the outer wall 13' that are not engaged by the resilient seal members 34' during the rotation of inner container 11' or, expressed otherwise, parts thereof that do not coincide with the path of relative movement of the seal members 34' during said rotation of the inner container. A flush water supply 62' is provided that in the illustrated exemplifying embodiment consists of a water hose 65' that through a hose connector 64' is connected to a through bore 63' in the outer housing 30' of the inlet unit 10'. The bore 63' is provided at a suitable height so as to open into an upper part 60'A of the recess 60' that is continuous around the circumference of the inner container 11'. Through said bore 63' in the wall 30'C of the outer housing 30' the water supply 62' therefore communicates continuously with the recess 60' to allow controlled intermittent flushing of the space or partial play that is formed between the outer housing 30' and the inner container 11' by the recess 60'. At the lower end of the inner container 11' lower parts 60'B of said recess 60' communicates, through cut-outs 61' through the inner container, with the liquid drain 24' in the bottom 22' of the outer housing 30' to allow discharge of the flush water therethrough. Although the water supply has for simplicity been illustrated as a single connection positioned close to the waste outlet opening 31' in the outer housing 30', it should be emphasized that the invention is not restricted to the use of only one water supply or to the illustrated positioning. In most practical applications the water supply may advantageously be provided approximately midway between the inlet and outlet openings in the outer housing.

The invention has been described and illustrated with specific reference to applications of the inventive system to residential buildings and houses, but the invention is in no way restricted to such applications. The basic principles of the invention may with small modifications be applied to any other type of building, such as an office building, as well as to different types of vehicles and vessels, such as passenger ships, ferries and passenger aircrafts where waste is generated at different locations. Depending upon the actual application, and specifically upon the type of energy source being available for the system, the invention also covers alternatives to the manual rotation of the inlet unit inner container, such as electrical, pneumatic or hydraulic motors.

Although the invention has been described herein with specific reference to the illustrated embodiments thereof, it should be pointed out that the invention is not restricted thereto. Modifications and variations thereof that are obvious to the man skilled in the art may therefore be performed without departing from the basic scope of the invention, said scope being solely determined by the attached claims.

The invention claimed is:

1. An inlet unit (10; 10') for the introduction of domestic waste material therein and having a closeable waste inlet opening (12), a waste compartment (14) for receiving waste material introduced therein, a waste outlet (15, 31), an atmospheric air inlet (16, 32) and air flow valve (34), characterized by:

an inner container (11) forming the waste compartment (14) and being supported for rotation in an outer housing (30) having the closeable waste inlet opening (12) communicating with the waste compartment;

a waste outlet opening (15) and an atmospheric air inlet opening (16) being provided at a circumferential distance from each other in a peripheral outer wall (13) of the inner container;

a waste outlet opening (31) and an atmospheric air inlet opening (32) being provided in an outer wall (30C) the outer housing (30) and at a circumferential distance from each other corresponding to the one between the waste outlet opening (15) and atmospheric air inlet opening (16) in the inner container (11);

and in that the inner container is adjustable by rotation between a storage volume charging position (SCP) wherein the waste outlet openings (15, 31) and atmospheric air inlet openings (16, 32) of the inner container and the outer housing, respectively, are substantially aligned and an inlet charging position (ICP) wherein said respective waste outlet openings (15, 31) and atmospheric air inlet openings (16, 32) are hermetically sealed from each other.

2. The inlet unit (10) according to claim 1, wherein the air flow valve (34) includes; resilient seal members (34) attached to the outer housing (30) and each surrounding the waste outlet opening (31) and atmospheric air inlet opening (32), respectively, thereof and sealingly engaging an outer surface of the peripheral outer wall (13) of the inner container (11) during the rotation of said inner container.

3. An inlet unit (10) according to claim 2, wherein a liquid drain (24) provided in an otherwise closed bottom (22) of the outer housing (30) of the inlet unit (10).

4. A domestic waste management vacuum system (1; 101; 201; 301) having at least one inlet unit (10; 10') according to claim 2, that is connected to a temporary storage volume (3; 103; 203; 303A 303B) for controlled removal of collected waste therefrom.

5. The inlet unit (10) according to claim 1, wherein a liquid drain (24) is; provided in an otherwise closed bottom (22) of the outer housing (30) of the inlet unit (10).

6. An inlet unit (10) according to claim 1, further comprising a recess (60') covering parts of the outer surface of the peripheral outer wall (13') of the inner container (11') that are not engaged by the resilient seal members (34') during the rotation of said inner container, a flush water supply (62') connected to the outer housing (30') of the inlet unit (10') and communicating with the recess and in that the recess communicates with the liquid drain (24') in the bottom (22') of the outer housing (30') to discharge the flush water therethrough.

7. A domestic waste management vacuum system (1; 101; 201; 301) having at least one inlet unit (10; 10') according to claim 1, that is connected to a temporary storage volume (3; 103; 203; 303A 303B) for controlled removal of collected waste therefrom.

8. The domestic waste management vacuum system (1; 101; 201; 301) according to claim 7, wherein the temporary storage volume (3; 103; 203; 303A, 303B) has a selectively closeable waste discharge (7, 3A; 107; 207; 307) and in that the temporary storage volume (3; 103; 203; 303A, 303B) separate from the waste material discharge, has a controlled vacuum inlet (5; 105; 205; 305) for selectively applying charging vacuum (CV) thereto.

9. The system (1; 101; 201; 301) according to claim 8, further comprising detecting means (40) for detecting a value representative of the vacuum level of the charging vacuum (CV) close to the waste outlet (15, 31) from each inlet unit (10) and by control means (37) for receiving information from said detecting means, for comparing said received information with a preset minimum vacuum level value and for controlling operation of the air flow valve (34) of each inlet unit and thereby the connection of the waste outlet to the temporary storage volume (3; 103; 203; 303A, 303B) and the air inlet opening (16, 32) to the atmosphere based on said comparison, to thereby block communication of charging vacuum to the waste compartment (14) of each individual inlet unit when the value of the sensed vacuum level is below the set lower limit.

10. The system (1; 101; 201; 301) according to claim 8, characterized in that the waste outlet (15, 31) of each inlet unit (10) is connected to the temporary storage volume (3; 103; 203; 303A, 303B) through a waste pipe (8) or a network (108) of waste pipes linked to each other.

11. The system (1) according to claim 8, for application to a residential single or two-family detached or semi-detached house (4), characterized in that the inlet unit or each inlet unit (10) is connected to the storage volume (3) through a separate waste pipe (8) and that the storage volume has an openable bottom (3A, 7) for emptying of the collected waste therefrom by gravity.

12. The system (101) according to claim 8, for application to a residential multi-story building (104), characterized in that each inlet unit (10) is connected to the storage volume (103) through a separate waste pipe (8) or alternatively through a pipe network (108), that the storage volume is extended as a waste shaft through the building and that the storage volume is integrated in a vacuum waste transport system (102, 160, 161) connected to the waste shaft for applying waste transport vacuum (VT) thereto from a collection central (160) spaced from the inlet units, and through a waste shaft discharge valve (107) opening into a transport pipe (102).

13. The system (1; 101; 201; 301) according to claim 7, further comprising detecting; means (40) for detecting a value representative of the vacuum level of the charging vacuum (CV) close to the waste outlet (15, 31) from each inlet unit (10) and control means (37) for receiving information from said detecting means, for comparing said received information with a preset minimum vacuum level value and for controlling operation of the air flow valve (34) of each inlet unit and thereby the connection of the waste outlet to the temporary storage volume (3; 103; 203; 303A, 303B) and the air inlet opening (16, 32) to the atmosphere based on said comparison, to thereby block communication of charging vacuum to the waste compartment (14) of each individual inlet unit when the value of the sensed vacuum level is below the set lower limit.

14. The system (1; 101; 201; 301) according to claim 13, characterized in that the waste outlet (15, 31) of each inlet unit (10) is connected to the temporary storage volume (3; 103; 203; 303A, 303B) through a waste pipe (8) or a network (108) of waste pipes linked to each other.

15. The system (1; 101; 201; 301) according to claim 7, wherein in that the waste outlet (15, 31) of each inlet unit (10) is connected to the temporary storage volume (3; 103; 203; 303A, 303B) through a waste pipe (8) or a network (108) of waste pipes linked to each other.

16. The system (1) according to claim 7, for application to a residential single or two-family detached or semi-detached house (4), wherein in that the inlet unit or each inlet unit (10) is connected to the storage volume (3) through a separate waste pipe (8) and the storage volume has an openable bottom (3A, 7) for emptying of the collected waste therefrom by gravity.

17. The system (101) according to claim 7, for application to a residential multi-story building (104), wherein in that each inlet unit (10) is connected to the storage volume (103) through a separate waste pipe (8) or alternatively through a pipe network (108), the storage volume is extended as a waste shaft through the building and that the storage volume is integrated in a vacuum waste transport system (102, 160, 161) connected to the waste shaft for applying waste transport vacuum (VT) thereto from a collection central (160) spaced from the inlet units, and through a waste shaft discharge valve (107) opening into a transport pipe (102).

18. The system (201; 301) according to claim 7, for application to an area of residential single or two-family detached or semi-detached houses (4) or to a residential multistory building (104), wherein in that each inlet unit (10) is connected to an associated storage volume (203; 303A, 303B) through a separate waste pipe (8) or alternatively through a pipe network (108), that the storage volume or volumes is/are integrated in a mobile vacuum waste transport system (80) connected to the storage volume or volumes for applying waste transport vacuum (TV) thereto from a vacuum truck (81), through a waste discharge valve (207; 307) opening into a transport pipe (202; 302).

19. The system (1; 101; 201; 301) according to claim 7, wherein in that each of said inlet units (10) is arranged in a separate apartment (4; 104A-104H), supported in a kitchen bench top (46).

20. The system (1; 101; 201; 301) according to claim 7, wherein by a vacuum release valve (6; 106) for selectively introducing atmospheric air (AA) into the temporary storage volume (3; 103; 203; 303A, 303B).

* * * * *